United States Patent [19]

Fealey

[11] Patent Number: 4,858,812

[45] Date of Patent: Aug. 22, 1989

[54] NAIL DRIVING DEVICE WITH IMPROVED NAIL FEEDING MECHANISM

[75] Inventor: William S. Fealey, Jamestown, R.I.

[73] Assignee: Stanley-Bostitch, Inc., East Greenwich, R.I.

[21] Appl. No.: 212,484

[22] Filed: Jun. 28, 1988

[51] Int. Cl.[4] ..... B25L 1/04

[52] U.S. Cl. ..... 227/116; 227/130; 227/139; 227/156

[58] Field of Search ..... 227/116, 130, 139, 156

[56] References Cited

U.S. PATENT DOCUMENTS

| | | |
|---|---|---|
| 3,450,255 | 6/1969 | Mosetich . |
| 3,543,987 | 12/1970 | Obergfell et al. . |
| 3,558,031 | 1/1971 | Hillier . |
| 3,703,981 | 11/1972 | Smith . |
| 3,708,097 | 1/1973 | Fisher . |
| 3,945,551 | 3/1976 | Sato et al. . |
| 4,091,981 | 5/1978 | Moriguchi et al. . |
| 4,253,598 | 3/1981 | Haytayan . |
| 4,319,705 | 3/1982 | Geist et al. . |
| 4,581,964 | 4/1986 | Takatsuru . |
| 4,585,154 | 4/1986 | Fealey et al. . |

*Primary Examiner*—Paul A. Bell

*Attorney, Agent, or Firm*—Cushman, Darby & Cushman

[57] ABSTRACT

An improved nosepiece and nail feeding assembly operable to accommodate different nail packages within a range of nail sizes of 1½" to 4". The assembly includes structure defining the lower end of the drive track which includes a replaceable annular member at the discharge end made of wear resistant material and a feed tooth of substantial length disposed thereabove when a nail is being driven which closes the adjacent area of communication between the drive track and the nail feed track to avoid jams but is capable of resiliently yielding to avoid damage during inadvertent jams.

15 Claims, 3 Drawing Sheets

NAIL DRIVING DEVICE WITH IMPROVED NAIL FEEDING MECHANISM

This invention relates to fastener driving devices and, more particularly, to pneumatically actuated fastener driving devices for driving coiled packages containing circular headed nails.

The type of nail coil package herein contemplated is specifically disclosed in copending application, Ser. No. 558,533, filed Dec. 6, 1983. The fastener package described in the aforesaid application is made up of a series of circular headed nails interconnected in an array by a pair of parallel wires welded to the shanks of each nail in the array so as to maintain them in substantially parallel relation. The parallel wires extend at an angle with respect to the axis of the shanks so as to engage within a feed track in the fastener driving device which extends downwardly and forwardly into communication with the drive track. This angular disposition of the feed track and associated components including the coil package canister is highly desirable in that it enables the device to be readily canted to achieve toenailing and the like.

The feeding mechanism for nail coil packages of the type described have heretofore been of the ratchet feed type. Examples are disclosed in U.S. Pat. Nos. 4,585,154 and 3,945,551. The utilization of nails of this type is highly advantageous. However, because of the nature in which the successive nails are interconnected and the full circular head configuration of the nails, difficulties are presented in controlling the movement of the nail through the drive track. As suggested in U.S. Pat. Nos. 3,703,981 and 3,708,097, it is the usual situation for the ratchet mechanism to feed off of the nail shank which is adjacent to the leading nail. It will be understood that, if a shank engaging surface of a feed member operates on the leading nail, the shank engaging surface would interfere with the movement of the head during the driving action. Since the feed track must communicate with the drive track in order to allow entry of the nail shank from the feed track into the drive track, a difficulty with respect to nail control is presented by nail movement along this space during the drive stroke of the nail driving element. Typically, the leading nail which is disposed in the drive track is initially supported in the drive track by the wires which extend from the adjacent shank. These wires extend over edges provided by the feed mechanism so that during the initial movement of the leading nail downwardly, the wires are moved into engagement with the edges which aid in severing the same. Nevertheless, the attachment of the wires between the leading nail and adjacent nail during the initial downward movement of the leading nail prior to wire severance tends to cause the two nails to be moved toward one another. In effect, this tends to cock the leading nail in the drive track. This situation can be accommodated where the fastener driving device is designed to take a relatively small range of nail sizes. The problems become severe when attempts are made to accommodate a full range of nail sizes from 1½ inch shank length to 4 inch shank length. The control is particularly severe in the smaller sizes because of the extensive amount of travel which must be undertaken without full control of the nail. Additionally, the larger sizes are subject to excessive buckling, particularly if shank diameter is less than 0.131". Moreover, the situation is further complicated because as the nail size varies, so does the spacing of the wires from the head of the nail. Consequently, in order to accommodate a full size range, the mechanism must also accommodate the various different positions at which the wires occur. The problems are sufficiently difficult that, at the present time, there has been no commercially acceptable device which is capable of operating throughout the full size range. Accordingly, there exists a need to provide such a device.

It is the object of the present invention to fulfill the need described above. In accordance with the principles of the present invention, this objective is obtained by providing a feeding mechanism which includes an actuating rod having a longitudinal axis mounted on the nosepiece assembly with its axis extending in the direction of extent of the feed track for (1) pivotal movement about its axis and (2) axial reciprocating movement from a retracted position in a direction toward the drive track through a feed stroke into an extended position and from said extended position in a direction away from the drive track through a return stroke into the retracted position. A nail feeding member is mounted on the actuating rod for pivotal and axial reciprocating movements with the actuating rod and for pivotal movement relative to the actuating rod about an axis parallel with the extent of the drive track in opposite directions. A first spring is provided for biasing the nail feeding member to pivotally move with respect to the actuating member in one direction into a nail engaging position and for resiliently resisting pivotal movement in the opposite direction into a nail clearing position. A second spring means is provided for effecting axial movement of the actuating rod through its feed stroke and for resiliently resisting axial movement in a direction away from the drive track. A power operated assembly is provided for effecting axial movement of the actuating rod through its return stroke and for enabling the second spring to effect the feed stroke thereof and to resiliently resist axial movement thereof in the direction away from the drive track when the actuating rod is in its extended position. A nail holding member is mounted for pivotal movement about an axis parallel with the extent of the drive track in opposite directions, and a third spring is provided for biasing the nail holding member to pivotally move in one direction into a nail holding position and for resiliently resisting movement in the opposite direction into a nail clearing position. The drive track includes a tubular discharge end and operatively fixed surfaces leading thereto for preventing substantial lateral movement of the shank of a nail being driven in the drive track except in the position of and direction of communication of the feed track therewith. The feed track includes operatively fixed laterally spaced first and second head controlling surfaces facing inwardly with respect to the drive track in a direction away from the discharge end thereof for engaging the nail heads and supporting the nails in the feed track. The feed track further includes operatively fixed laterally spaced first and second shank controlling surfaces facing toward one another and disposed outwardly of the first and second head controlling surfaces for controlling nail shank movement in a direction laterally of the direction of extent of the feed track. The nail feeding member has a leading series of teeth aligned and spaced apart in the direction of extent of the drive track and a second series of teeth aligned and spaced apart in the direction of extent of the drive track spaced apart from the leading series of teeth in the direction of extent of the feed track. The second series of teeth have feed surfaces facing toward the drive track for engaging a nail shank in the feed track and moving the leading nail in the feed track into the drive track during the feed stroke of the actuating rod when the nail feeding member is in its nail engaging position. The nail holding member has cam surfaces operable during the feed stroke of the actuating rod to be engaged by a moving nail shank to initially effect a pivotal movement of the nail holding member in the opposite direction against the resilient resistance of the third spring means into the nail clearing position and thereafter to allow a pivotal movement of the nail holding member in the one direction under the bias of the third spring into its nail holding position. The nail holding member has nail holding surfaces facing in a direction toward the drive track for engaging a nail shank when the nail holding member is in its nail holding position. The teeth have cam surfaces operable during the return stroke of the actuating rod to initially effect pivotal movement of the nail feeding member by engagement with a nail shank in the opposite direction into the nail clearing position and to thereafter allow the first spring to effect pivotal movement of the nail feeding member in the one direction into the nail engaging position. The leading series of teeth include drive track closing surfaces facing in a direction toward the drive track operable when the actuating rod is in its extended position and the nail feeding member is in its nail engaging position to close a substantial extent of the area of communication of the feed track with the drive track and to prevent substantial lateral shank movement within the drive track in the direction of feed track communication. The leading series of teeth further include an outermost tooth having a laterally facing surface disposed closely adjacent and preferably in contact with the second shank controlling surface when the actuating rod is in its extended position or moving to its extended position and the nail feeding member is in its nail engaging position so as to insure that a drive track closing surface of the outermost tooth elongated in the direction of extent of the drive track closes an area of communication of the feed track with the drive track adjacent the discharge end thereof and normally prevents canting of relatively short length nails in the drive track into the feed track, and prevents buckling of relatively long length nails in the drive track into the feed track except under the resilient resistance of the second spring when forces exerted would be great enough to otherwise potentially damage the mechanism. The nail feeding member has an abutment surface for engaging an operatively fixed portion of the nosepiece assembly when the nail feeding member is in its nail engaging position and the actuating rod is in or is moving to its extended position to positively prevent pivotal movement of the nail feeding member and the actuating rod about the axis of the latter in a direction tending to move the laterally facing surface away from closely adjacent relation and preferably in contact with the second shank controlling surface.

Preferably, the outermost tooth constitutes a fifth tooth in the leading series which also includes a fourth tooth spaced inwardly from the fifth tooth, a third tooth spaced inwardly from the fourth tooth, a second tooth spaced inwardly from the third tooth and a first tooth spaced inwardly from the second tooth. The first, second, third and fourth teeth have first, second, third and fourth wire engaging edges thereon respectively. The first and second wire engaging edges are operable to aid in severing the wires between the leading nail in the drive track and the adjacent nail in the feed track when 1½" nails are in the selected coil and the leading nail is driven by said fastener driving element during the drive stroke thereof. The second and fourth wire engaging edges are operable to aid in severing the wires between the leading nail in the drive track and the adjacent nail in the feed track when 4" nails are in the selected coil and the leading nail is driven by the fastener driving element during the drive stroke thereof. The second and third wire engaging edges are operable to aid in severing the wires between the leading nail in the drive track and the adjacent nail in the feed track when between 1½" and 4" nails are in the selected coil and the leading nail is driven by the fastener driving element during the drive stroke thereof.

In conjunction with the nail control accomplished by the present invention, it will be noted that the discharge end of the drive track is tubular. This discharge end is fixed and it is desirable that it be tubular so that control of the point of the nails as they are driven is maintained up to the point of entry into the workpiece. It will be recognized that when the charge of compressed air acts initially to begin the drive stroke downwardly, there is at the same time a recoil force tending to move the tool upwardly. This recoil force continues during a substantial portion of the movement and, since the tool is portable and held in the hand, there is a tendency for it to move in a direction forwardly and upwardly. Once the point of the nail enters the workpiece, the tendency of the tool itself to be moved forwardly and upwardly tends to effect a relative movement of the tool with respect to the nail engaged within the workpiece. Consequently, as the nail continues to move into engagement with the workpiece and out of the drive track, the trailing surface of the nail shank tends to engage the forwardly facing or leading surface of the discharge end of the drive track. Where the nails being driven are ring shank or screw shank type nails, this rubbing action creates a severe wear situation which is akin to a rasping action.

Accordingly, another object of the present invention is to provide in a fastener driving device of the type described a separate renewable annular member for defining the discharge end of the drive track which is formed of wear resistant material removably fixedly secured to a fixed portion of the nosepiece assembly. The annular member has a bore extending therethrough defining the discharge end of the drive track and presenting a forwardly facing surface portion for resisting abrasion when ring shank or screw shank nails are being driven from the drive track and into a workpiece which in the normal operation of the device tend to be displaced rearwardly within the drive track with respect to the device.

Another object of the present invention is the provision of a feeding mechanism for a fastener driving device of the type described which is simple in construction, effective in operation and economical to manufacture, by which provision is avoided, the use of components that otherwise would be in addition to the basic feed mechanism components.

These and other objects of the present invention will become more apparent during the course of the following detailed description and appended claims.

The invention may best be understood with reference to the accompanying drawings wherein an illustrative embodiment is shown.

Figure 1:
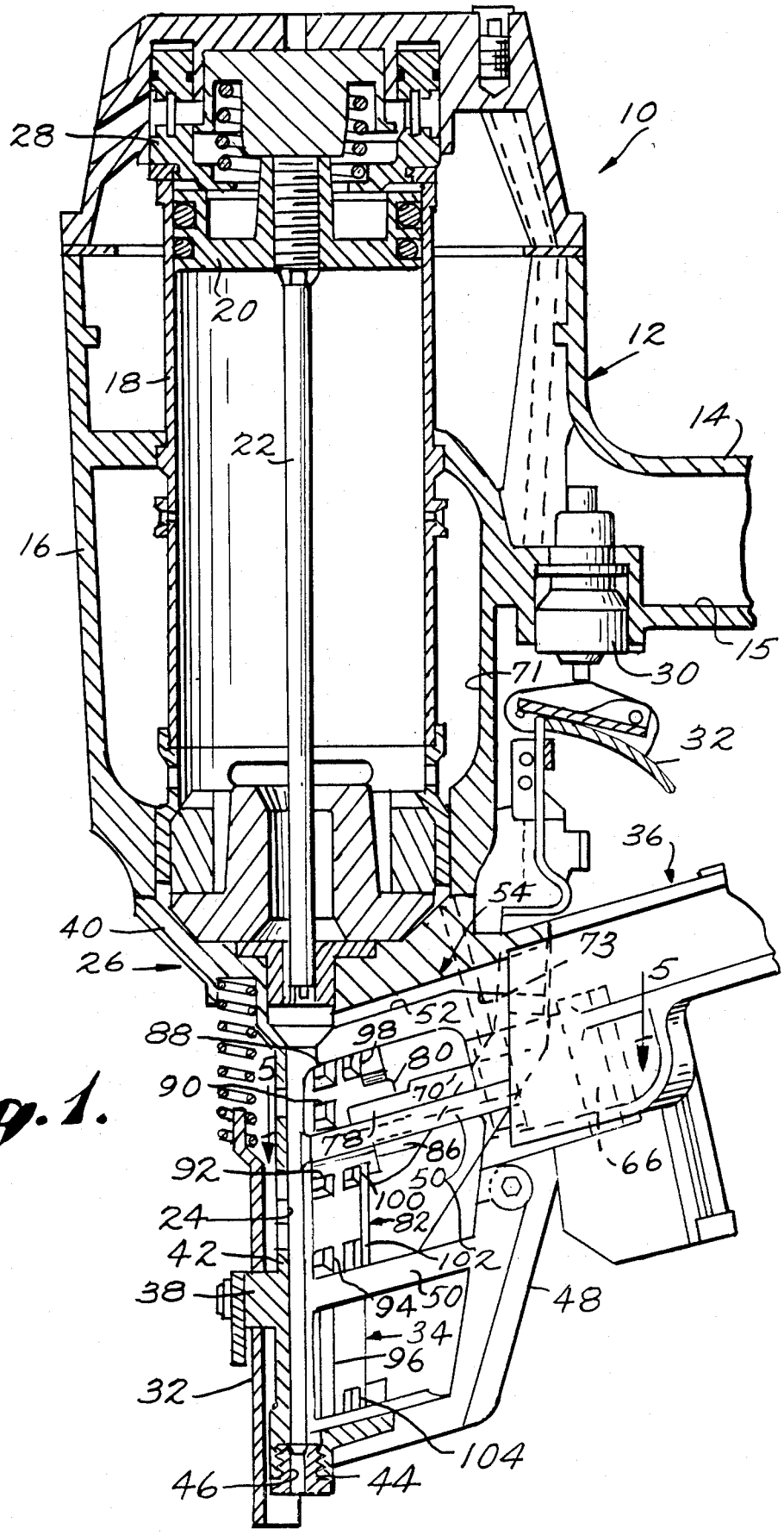
FIG. 1 is a vertical sectional view of the forward portion of a fastener driving device embodying the principles of the present invention.

Referring now more particularly to FIG. 1 of the drawings, there is shown therein a portable pneumatically operated fastener driving device in the form of a portable tool, generally indicated at 10, which embodies the improvements constructed in accordance with the principles of the present invention. As shown, the tool 10 includes a portable rigid housing assembly, generally indicated at 12, which provides a handle portion 14 and a driving cylinder containing portion 16 extending generally at a right angle at the forward end of the handle portion 14. In accordance with conventional practice, a cylinder 18 is mounted within the housing portion 16, within which is slidably mounted a driving piston 20. A fastener driving element 22 is fixed to the driving piston and extends within a driving track 24 formed in a nosepiece assembly, generally indicated at 26, embodying the principles of the present invention, in a fixed position below the housing portion 16. In accordance with conventional practice, the handle portion 14 contains a reservoir 15 for receiving a source of air under pressure which is communicated with the upper end of the cylinder 18 by a pilot pressure operated main valve assembly 28. The pilot pressure operated main valve assembly 28 is under the control of a trigger valve assembly 30 operated by a contact trip and trigger assembly 32 in accordance with conventional procedures. The nosepiece assembly 26 includes a ratchet type fastener feeding mechanism, generally indicated at 34, embodying the principles of the present invention, which is operable to cooperate with a leading end portion of a coiled fastener package contained within a canister assembly 36.

It will be understood that the components other than the nosepiece assembly 26 and feeding mechanism 34 are illustrative only and that they may be of any known equivalent construction. The components other than the canister assembly 36 are exemplarily of the type disclosed in U.S. Pat. No. 3,945,551, the disclosure of which is hereby incorporated by reference into the present specification. The canister assembly 36 is preferably of the type disclosed in U.S. Pat. No. 4,585,154, the disclosure of which is also hereby incorporated by reference into the present specification.

Likewise, the coiled fastener packages utilized with the tool may be of any known construction. However, a preferred embodiment is disclosed in co-pending application, Ser. No. 558,533, filed Dec. 6, 1983, the disclosure of which is hereby incorporated by reference into the present specification. The fastener package disclosed in the aforesaid co-pending application is made up of a series of headed nails interconnected in an array by a pair of parallel wires welded to the shanks of each nail in the array so as to maintain them in substantially parallel relation. The wires are welded in angular relation (75°) across the parallel nail shanks. The array of nails is then wound into a coil formation in which the heads of alternate convolutes are disposed in overlapped and underlapped relation with respect to the heads of the preceding convolutes so as to present pointed and headed ends of the coiled package which are substantially flat. It will be understood that the present invention contemplates selecting any one of a series of different nail coils wherein the nails of the coils vary in size from 1½" to 4". Other types of flat coiled fasteners herein contemplated are disclosed in U.S. Pat. Nos. 3,450,255, 3,543,987, 3,558,031, and 4,319,705.

The nosepiece assembly 26 includes a rigid nosepiece member, generally indicated at 38, which includes an upper portion 40 suitably fixed to the housing portion 16 in a position below the cylinder 18. The nosepiece member 38 also includes a forward central depending portion 42 which is bored to define the drive track 24. The discharge end of the forward central portion 42 is of tubular form and is formed with a counterbore which is threaded to threadedly receive the exterior threads of a separate annular member in the form of a flanged bushing 44. The flanged bushing is formed with a bore 46 which defines the discharge end of the drive track 24. The bushing is fixed by virtue of the threaded connection with the nosepiece member 38 but is replaceable and is formed of a hardened and tempered wear resistant material of the type which is not suitable to use for manufacture of the nosepiece member 38 in its entirety.

The nosepiece member 38 also includes a rearward portion 48 extending rearwardly from the drive track defining portion 42 and between the upper portion 40 and bushing 44 which is formed with a vertically extending surface 50 intersecting with the surface defining the drive track. At a position at the upper junction of the surface 50 with the upper portion 40 of the nosepiece member 38, the nosepiece member 38 is formed with a groove 52 which defines an upwardly facing inclined surface which is adapted to engage beneath the heads of the nails to support the same so that their shanks extend along the vertical surface 50. The rearward portion 48 of the nosepiece member is skeletonized or formed with lateral openings which create a pair of vertically spaced elongated elements in the central area of the rearward portion 48. The surface 50 of the rearward portion 48 including these elements serves to control the movement of the nail shanks suspended by their heads in groove 52 in a downward and forward direction at an angle of 15° toward the drive track 24 and thus define one side of a nail feed track, generally indicated at 54, which communicates with the drive track 24 at a position between the groove 52 and the discharge end bushing 44. It will be understood that the canister assembly 36 contains a selected nail coil that is manually engaged in operative relation with the feeding mechanism 34 by engaging the heads of the nails in the leading portion of the array forming the coil within the groove 52 and the shanks in engagement with the surface 50.

Figure 5:
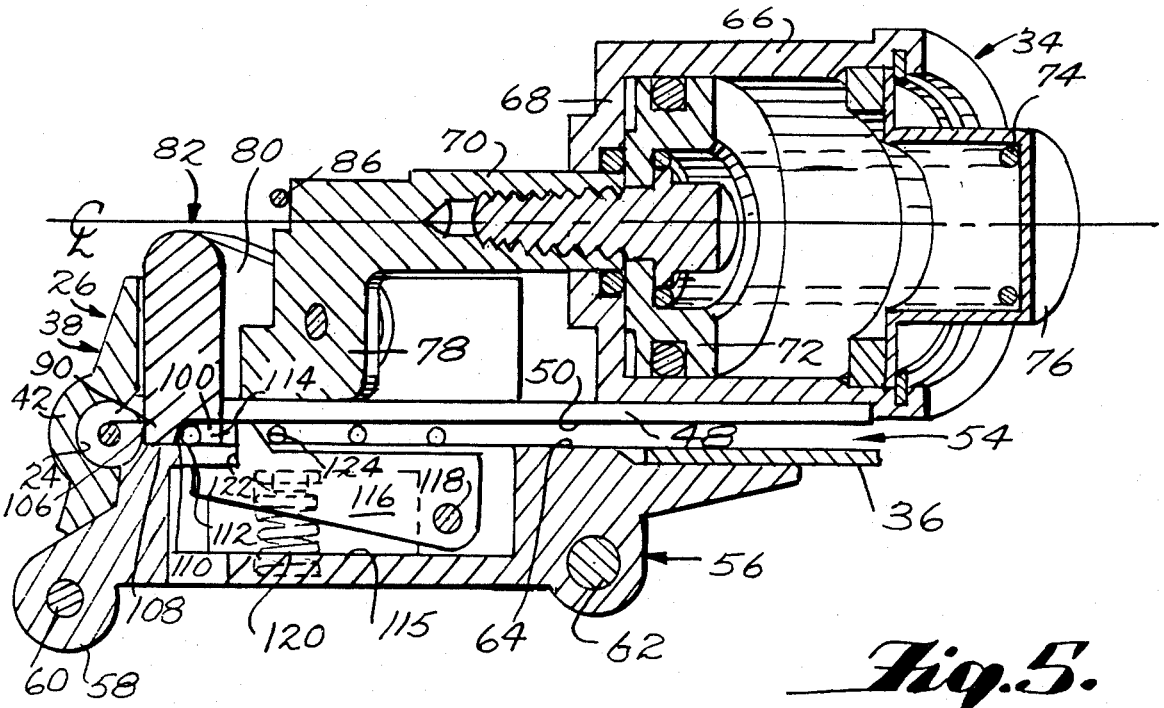
FIG. 5 is a sectional view taken along the line 5—5 of FIG. 1 showing the position of the parts of the feed mechanism at the end of a feed stroke.
Figure 6:
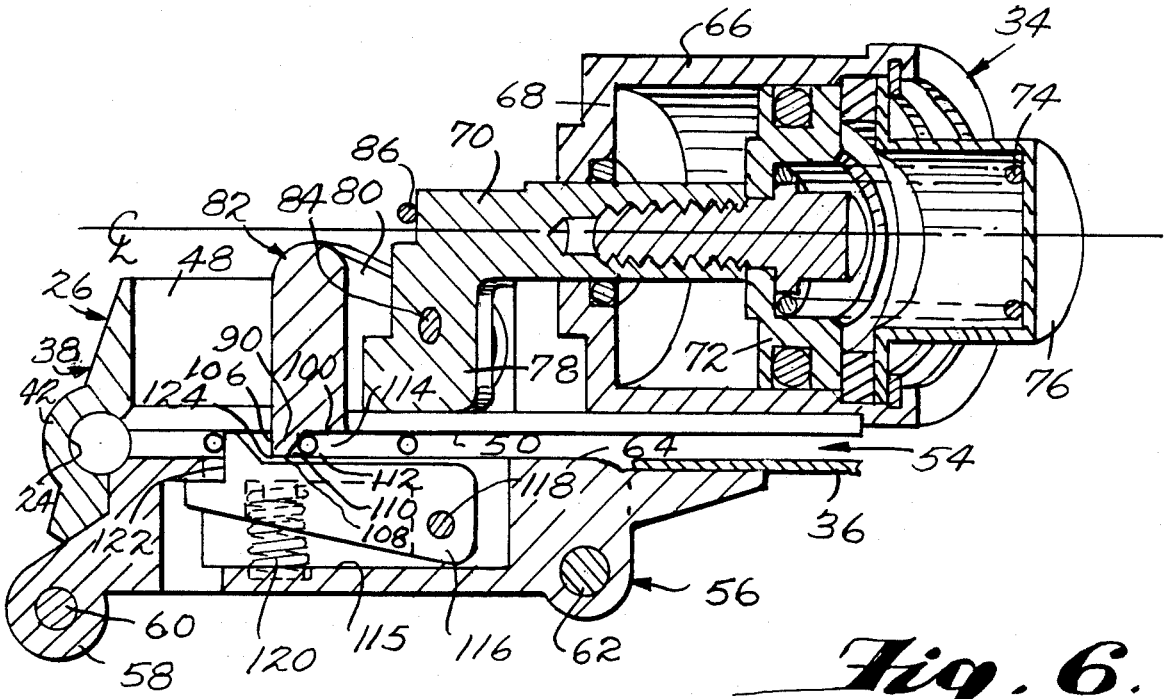
FIG. 6 is a view similar to FIG. 5 showing the position of the parts of the feed mechanism at the end of the return stroke.

As best shown in FIGS. 5 and 6, the nosepiece assembly 26 also includes a door member, generally indicated at 56, having forward apertured lugs 58 which are pinned, as by a hinge pin 60, to similar apertured lugs formed on the fixed nosepiece member 38 in laterally spaced relation from the drive track defining portion 42 thereof. The hinge pin 60 serves to pivotally mount the door member 56 for movement between two positions one of which is an open access position wherein the groove 52 and surface 50 of the fixed nosepiece member 38 are exposed to be operatively engaged with the nail array. The door member is movable from its open position into a fixed closed position as illustrated in FIGS. 5 and 6. The door member 56 is fixed in its closed position by a latch including a slidable bolt 62 which engages within a suitable bore in the upper portion 40 of the nosepiece member 38. In its closed position, the door member 56 provides a nail shank controlling surface 64 which is disposed in opposed laterally spaced relation with respect to the surface 50 and leads to the drive track 24 and thus defines the other side of the feed track 54. The door member is formed with a nail head controlling groove (not shown) in an opposite position with the groove 52.

As best shown in FIGS. 5 and 6, the rearward portion 48 of the fixed nosepiece member 38 has a cylinder 66 formed in the upper rear section thereof in laterally offset relation with respect to the surface 50. The cylinder 66 includes a forward wall 68 apertured and sealed to sealingly receive therethrough an actuating rod 70.

It will be noted that the interior of the cylinder 66 adjacent the forward wall 68 is communicated with a conventional plenum chamber return system 71 of the fastener driving device 10, as by a passageway 73 (see FIG. 1), so as to direct a supply of air under pressure therein at the end of the drive stroke of the fastener driving element 22. This pressure serves to move a piston 72 fixed to the rearward end of the actuating rod 70 and slidably mounted within the cylinder 66 into a retracted position, such as shown in FIG. 6. The piston 72 and actuating rod 70 are moved forwardly from the retracted position, as shown in FIG. 6, into an extended position, as shown in FIG. 5, by a coil spring 74 which has at one end engaged with the piston 72 and an other end engaged within a cap 76 mounted in the open rear end of the cylinder 66.

The actuating rod 70 extends forwardly and downwardly through the forward wall 68 of the cylinder 66 and has a laterally offset portion 78 formed on the forward end thereof which is apertured and disposed between a pair of apertured lugs 80 formed on the rear surface of a nail feeding member, generally indicated at 82. A pin 84 extends through the aperture of the lateral portion 78 of the actuating rod 70 and the apertured lugs 80 of the nail feeding member 82 and serves to pivotally mount the nail feeding member on the actuating rod 70 for movement therewith along and about its axis and for relative pivotal movement with respect to the actuating rod 70 between a nail engaging position, as shown in FIGS. 5 and 6, and a nail clearing position. A hairpin type coil spring 86 serves to resiliently bias the nail feeding member 82 into its nail engaging position and to resiliently resist movement out of such position into the nail clearing position thereof.

The lateral surface of the nail feeding member 82 is suitably recessed to receive the elongated elements of the rearward portion 48 of the nosepiece member 38 and extends within the openings in the fixed nosepiece member 38. Formed on the forward lateral surface of the nail feeding member 82 is a leading series of vertically spaced teeth 88, 90, 92, 94, and 96. A second series of vertically spaced teeth 98, 100, 102, and 104 are formed on the rearward lateral surface of the nail feeding member in rearwardly spaced relation from the leading series. The teeth of the leading series are formed with vertically aligned forwardly facing surfaces 106 which, when the nail feeding member 86 is in its nail engaging position and the actuating rod 70 is in its extended position, serves to close off a substantial portion of the area of communication between the drive track 24 and the feed track 54. The leading teeth also include laterally facing surfaces 108 which either engage or are disposed in closely spaced relation with the surface 64 of the door member 56. The leading teeth also include rearwardly inclined cam surfaces 110. Similarly, the second series of teeth include forwardly facing nail feeding surfaces 112 and rearward cam surfaces 114 engaging the nail shanks and feeding the same.

The door member 56 is formed with a central recess 115 opening into the feed track 54 within which is mounted a nail holding member or pawl 116. As shown, a pin 118 serves to mount the nail holding member 116 for pivotal movement between a nail engaging position, as shown in FIGS. 5 and 6, and a nail clearing position. The nail holding member 116 is resiliently biased into its nail engaging position by a coil spring 120 which extends between the door member 56 and the nail holding member 116 and serves to resiliently resist pivotal movement of the member 116 in a direction toward the nail clearing position thereof. The nail holding member 116 includes a lateral tooth portion providing a forwardly facing nail holding surface 122 and a rearwardly inclined cam surface 124.

Figure 4:
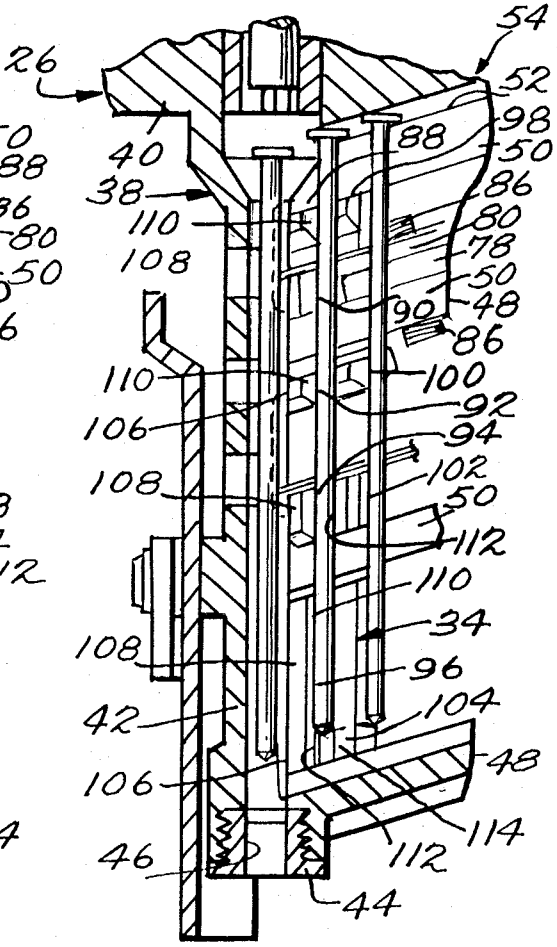
FIG. 4 is a view similar to FIG. 2 showing 4" nails operating in the feeding mechanism.
Figure 3:
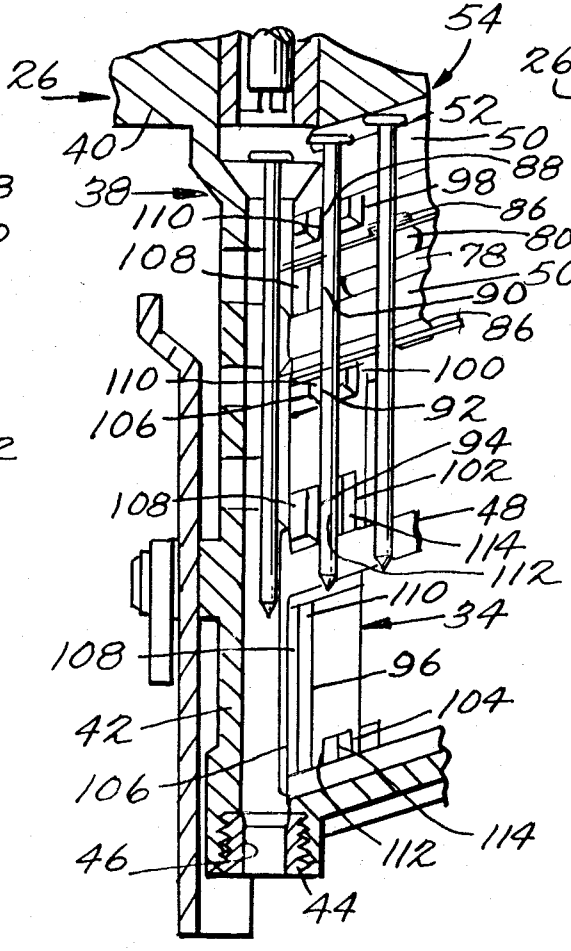
FIG. 3 is a view similar to FIG. 2 showing 3" nails operating in the feeding mechanism.
Figure 2:
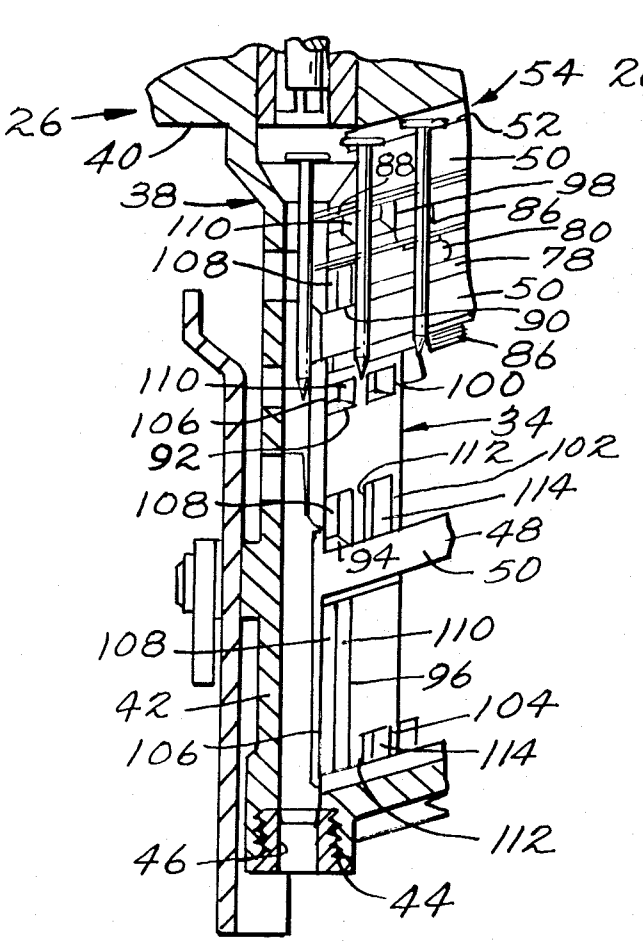
FIG. 2 is an enlarged fragmentary sectional view showing the feeding mechanism with 1½" nails operating therein.

FIGS. 2, 3, and 4 illustrate the manner in which the nosepiece assembly 26 and feeding mechanism 34 of the present invention are able to accommodate a range of nail sizes from 1½" to 4". FIG. 2 illustrates a 1½" nail coil and it will be noted that the array of nails is supported in the feed track 54 by engagement of the lower surfaces of the heads with the upwardly facing surfaces of the grooves 52. It will also be noted that the parallel wires holding the nails in the array are positioned so that the upper wire is above the innermost or first tooth 88 and the lower wire is above the second tooth 90. The forward and upper edges of these teeth materially aid in severing the wires during the initial movement of the leading nail in the drive track 24 in response to the drive stroke of the fastener driving element 22.

FIG. 3 illustrates how a 3" nail coil is accommodated and, here again, it will be noted that the array of nails is supported in the same fashion by their heads. In this instance, however, the upper wire holding the nails in the array is above the second leading tooth 90 while the lower wire is above the third leading tooth 92. Here again, these two teeth have their forward upper edges positioned to aid in severing the wires during the driving action.

FIG. 4 illustrates the accommodation of a 4" nail coil and, here again, it will be noted that the nails are supported from their heads by the upwardly facing surface of the grooves 52 and that the upper wire holding the nails in the array is disposed above the second leading tooth 90 while the lower wire is disposed above the fourth leading tooth 94. Here again, these teeth have their forward upper edges arranged so as to materially aid in severing the wires during the drive stroke of the nail.

The operating cycle of the feeding mechanism 34 is illustrated in FIGS. 5 and 6. FIG. 5 illustrates the position of the parts after a feed stroke has been accomplished and it will be noted that such a feed stroke will be completed during the return stroke of the fastener driving element 22. As soon as the lower end of the fastener driving element 22 clears the feed track 54, the spring 74 is operable to move the actuating rod 70 from its retracted position, as shown in FIG. 6, into its extended position, as shown in FIG. 5. It will be noted that the forwardly facing surfaces 106 of the leading teeth 88, 90, 92, 94, and 96 are disposed in a position to close a substantial portion of the area of communication between the drive track 24 and the feed track 54. Specifically, the lowermost leading tooth 96 serves to close the lower portion of the drive track 24 above the discharge end bushing 44 and prevents particularly smaller nails from being canted, as the wires are severed, and then driven into the lower end of the feed track 54. It is noted that the lateral surface 108 of the lowermost tooth 96 is engaged or disposed in closely spaced relation with the surface 64 such that a nail cannot get between the two surfaces. Moreover, it is important to note that the laterally facing surface 108 of the innermost or first tooth 88 is disposed in engagement with the surface 64. This interengaging relationship which is disposed above the axis of the actuating rod 70 thus serves to prevent a pivotal movement of the actuating rod 70 about its axis together with the nail feeding member 82, which would enable the laterally facing surface 108 of the lowermost tooth 96 to move away from the surface 64. This insures that a nail which attempts to penetrate between the two surfaces 64 and 108 will be resisted. Moreover, it will be noted that during the drive stroke of the fastener driving element 22, the spring 74 maintains the actuating rod 70 in its extended position together with the nail feeding member 82 so that any attempt of the nail being driven to enter into the lower portion of the feed track 54 is resisted by the forwardly facing surface 106 of the lowermost leading tooth 96. The spring 74, however, does allow the surface 106 and the entire nail feeding member 82 to move rearwardly in the rare event of extreme forces, such as might be associated with an inadvertent jam, thereby protecting the feed mechanism components from accelerated wear or damage. Spring 74 is, however, sufficiently strong to prevent the buckling of long 3½" to 4" nails, thereby eliminating a major cause of jamming.

It will be noted that, when the nail point begins to pass out of the discharge end of the drive track 24 and into engagement with the workpiece, the recoil of the tool 10 and the manual engagement of the handle 14 are such as to tend to cause the tool 10 to move forwardly and upwardly which movement tends to effect a relative movement of the entire tool 10 with respect to the nail engaged in the workpiece thus causing the trailing surface of the shank of the nail to engage the leading surface of the bushing bore 46. However, because the bushing is made of wear resistant material, this abrasive action does not result in excessive wear in a small portion of a relatively large nosepiece member 38 but, instead, the bushing 44 can be replaced with a new one as wear takes place. This is particularly desirable when the nails are ring or screw shanked nails since they tend to provide a greater amount of wear than smooth shanked nails.

During the return stroke of the fastener driving element 22, the cylinder 66 is pressurized to move the piston 72 and actuating rod 70 into its retracted position against the bias of the spring 74. As this return stroke of the actuating rod 70 takes place, the nail feed member 82 is moved therewith likewise through a return stroke. The cam surfaces 110 of the leading teeth are in substantial engagement with the leading nail in the feed track 54 and during the return stroke the cam surfaces 110 serve to move the nails in the feed track 54 rearwardly until the leading nail in the feed track moves into engagement with the holding surface 122 of the nail holding member 116. When this engagement takes place, the leading nail cannot move any further rearwardly and thus the further rearward movement of the nail feeding member 82 results in the cam surfaces 110 engaging the nail and effecting a pivotal movement of the nail holding member 82 against the bias of spring 86 into its nail clearing position.

Where the diameter size of the shanks of the nails utilized in the coil are relatively small, the nail feeding member 82 will move back into its nail engaging position as the laterally facing surfaces 108 of the leading teeth leave the surface of the leading nail being held by the nail holding member 116. Where large size diameter nails are used, a full return movement to the nail engaging position as described above will be replaced by a partial return or no return by reason of the second series of teeth hitting on the next nail. When the nail feeding member 82 reaches either partly into or entirely into its nail engaging position, the next adjacent nail in the feed track 54 is immediately rearwardly of the cam surfaces 114 on the second series of nails. As further movement takes place during the return stroke, the nail feeding member 82 is again cammed into its nail clearing position by the action of the cam surfaces 114 engaging the second nail which is held against rearward movement by the wires connecting the same to the leading nail which is held by the nail holding member 116. The extent of the return stroke is such that the nail feeding surfaces 112 of the second series of teeth move past the second nail and slightly rearwardly thereof as is shown in FIG. 6. As soon as the air pressure in the cylinder 66 is dissipated, the bias of spring 74 again becomes effective to effect a feeding stroke of the actuating rod 70 and feeding member 82. During this movement, the engagement of the nail feeding surfaces 112 with the second nail in the feed track 54 serves to move this nail forwardly and by virtue of the connecting wires, the leading nail likewise forwardly. This movement continues until the second nail being moved by the nail feeding surfaces 112 engages the cam surface 124 of nail holding member 116. The effect of this engagement is to pivot the nail holding member 116 out of its nail engaging position into its nail clearing position against the bias of the spring 120 after which the spring 120 serves to return the nail holding member 116 back into its nail engaging position. Thereafter, the completion of the feed stroke of the actuating rod 70 serves to move the leading nail into the drive track 24 as shown in FIG. 5, thus completing the cycle.

It thus will be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. In a nail driving device of the type including a portable housing having a nosepiece assembly defining a nail drive track terminating in a downwardly discharge facing end and a nail feed track extending downwardly and forwardly into lateral communication with said drive track above the discharge end thereof, a nail driving element mounted within said drive track for movement through repetitive cycles each including a drive stroke and a return stroke, power operated means for effecting the drive stroke of said nail driving element, and means for feeding successive nails from a package of such nails along said feed track into said drive track to be driven from the discharge end thereof into a workpiece during the drive stroke of said nail driving element, the improvement which comprises the discharge end of said drive track being formed by a separate annular member formed of wear resistant material fixedly secured to a fixed portion of said nosepiece assembly, said annular member having a bore extending therethrough defining the discharge end of said bore and presenting a forwardly facing surface portion for resisting abrasion when ring or screw shanked nails are being driven from the drive track and into a workpiece which in the normal operation of the device tend to be displaced rearwardly within the drive track with respect to the device.

2. The improvement as defined in claim 1 wherein said annular member includes an annular flange extending radially outwardly from the lower end thereof and exterior threads formed on the remainder of the exterior periphery thereof for engaging meshing interior threads on said fixed portion of said nosepiece assembly.

3. A fastener driving device including a fastener driving element movable through repetitive cycles of operation each of which includes a drive stroke and a return stroke, a mechanism for feeding successive fasteners from a fastener package into a position to be driven by said fastener driving element during the drive stroke thereof, the fastener package being in the form of a coil of circular headed nails interconnected in series with their shanks in spaced parallel relation selected from a number of different coils wherein the nails of the coils vary in shank length from 1½" to 4", said mechanism comprising a nosepiece assembly having means defining an elongated drive track receiving said fastener driving element therein during the operating cycle thereof and a nail feed track communicating laterally with said drive track, an actuating rod having a longitudinal axis, said actuating rod being mounted on said nosepiece assembly with its axis extending in the direction of extent of said feed track for (1) pivotal movement about its axis and (2) axial reciprocating movement from a retracted position in a direction toward said drive track through a feed stroke into an extended position and from said extended position in a direction away from said drive track through a return stroke into said retracted position, a nail feeding member mounted on said actuating rod for pivotal and axial reciprocating movements with said actuating rod and for pivotal movement relative to said actuating rod about an axis parallel with the extent of said drive track in opposite directions, first spring means for biasing said nail feeding member to pivotally move with respect to said actuating member in one direction into a nail engaging position and for resiliently resisting pivotal movement in the opposite direction into a nail clearing position, second spring means for effecting axial movement of said actuating rod through its feed stroke and for resiliently resisting axial movement in a direction away from said drive track, power operated means for effecting axial movement of said actuating rod through its return stroke and for enabling said second spring means to effect the feed stroke thereof and to resiliently resist axial movement thereof in the direction away from said drive track when said actuating rod is in said extended position, a nail holding member mounted for pivotal movement about an axis parallel with the extent of said drive track in opposite directions, and third spring means for biasing said nail holding member to pivotally move in one direction into a nail holding position and for resiliently resisting movement in the opposite direction into a nail clearing position, said drive track defining means including a tubular discharge end and operatively fixed surfaces leading thereto for preventing substantial lateral movement of the shank of a nail being driven in said drive track except in the position of and direction of communication of said feed track therewith, said feed track defining means including operatively fixed laterally spaced first and second head controlling surfaces means facing inwardly with respect to said drive track in a direction away from the discharge end thereof for engaging the nail heads and supporting the nails in said feed track, said feed track defining means further including operatively fixed laterally spaced first and second shank controlling surface means facing toward one another and disposed with respect to said first and second head controlling surface means to control nail shank movement in a direction laterally of the direction of extent of said feed track, said nail feeding member having a leading series of teeth aligned and spaced apart in the direction of extent of said drive track and a second series of teeth aligned and spaced apart in the direction of extent of said drive track spaced apart from said leading series of teeth in the direction of extent of said feed track, said second series of teeth having feed surface means facing toward said drive track for engaging a nail shank in said feed track and moving the leading nail in said feed track into said drive track during the feed stroke of said actuating rod when said nail feeding member is in said nail engaging position, said nail holding member having cam surface means operable during the feed stroke of said actuating rod to be engaged by a moving nail shank to initially effect a pivotal movement of said nail holding member in said opposite direction against the resilient resistance of said third spring means into said nail clearing position and thereafter to allow a pivotal movement of said nail holding member in said one direction under the bias of said third spring means into said nail holding position, said nail holding member having nail holding surface means facing in a direction toward said drive track for engaging a nail shank when said nail holding member is in said nail holding position, said teeth having cam surface means operable during the return stroke of said actuating rod to initially effect pivotal movement of said nail feeding member by engagement with a nail shank in said opposite direction into said nail clearing position and to thereafter allow said first spring means to effect pivotal movement of said nail feeding member in said one direction into said nail engaging position, said leading series of teeth including drive track closing surface means facing in a direction toward said drive track operable when said actuating rod is in said extended position and said nail feeding member is in said nail engaging position to close a substantial extent of the area of communication of said feed track with said drive track and to prevent substantial lateral shank movement within the drive track in the direction of feed track communication, said leading series of teeth including an outermost tooth having laterally facing surface means disposed closely adjacent said second shank controlling surface means when said actuating rod is in said extended position and said nail feeding member is in said nail engaging position, so as to insure that a drive track closing surface of said outermost tooth elongated in the direction of extent of said drive track closes an area of communication of said feed track with said drive track adjacent the discharge end thereof and normally prevents canting of relatively short length nails and buckling of relatively long thin shanked nails in said drive track into said feed track except under the resilient resistance of said second spring means, said nail feeding member having abutment surface means for engaging an operatively fixed portion of said nosepiece assembly when said nail feeding member is in said nail engaging position and said actuating rod is in said extended position to positively prevent pivotal movement of said nail feeding member and said actuating rod about the axis of the latter in a direction tending to move said laterally facing surface means of outermost tooth away from closely adjacent relation with said second shank controlling surface means.

4. A fastener driving device as defined in claim 3 wherein said outermost tooth constitutes a fifth tooth in said leading series which also includes a fourth tooth spaced inwardly from said fifth tooth, a third tooth spaced inwardly from said fourth tooth, a second tooth spaced inwardly from said third tooth and a first tooth spaced inwardly from said second tooth, the different coils from which the coil providing said fastener package is selected having parallel wires welded across the nail shanks at positions spaced from the heads distances which vary depending upon the length of the nail, said first, second, third and fourth teeth having first, second, third and fourth wire engaging edge means thereon respectively, said first and second wire engaging edge means being operable to aid in severing the wires between the leading nail in said drive track and the adjacent nail in the feed track when 1½" nails are in the selected coil and said leading nail is driven by said fastener driving element during the drive stroke thereof, said second and fourth wire engaging edge means being operable to aid in severing the wires between the leading nail in said drive track and the adjacent nail in the feed track when between 3½" and 4" nails are in the selected coil and said leading nail is driven by said fastener driving element during the drive stroke thereof, said second and third wire engaging edge means being operable to aid in severing the wires between the leading nail in said drive track and the adjacent nail in the feed track when between 1½" and 3½" nails are in the selected coil and said leading nail is driven by said fastener driving element during the drive stroke thereof.

5. A fastener driving device as defined in claim 4 wherein said abutment surface means comprises a laterally facing surface on said first tooth for engaging an area of said second shank controlling surface.

6. A fastener driving device as defined in claim 5 wherein said first head and shank controlling surface means are provided by a fixed nosepiece member and said second head and shank controlling surface means are provided by a door member pivotally mounted on said fixed nosepiece member for movement between a closed fixed operatively fixed position and an opened position providing access to said first head and shank controlling surfaces for fastener package exchanging purposes.

7. A fastener driving device as defined in claim 6 wherein said nail holding member is pivoted on said door member and said third spring means is mounted between said door member and said nail holding member.

8. A fastener driving device as defined in claim 7 wherein said first and second head controlling surfaces are planar surfaces extending at an included angle with the direction of extent of said drive track of approximately 75° and the tubular discharge end of said drive track is provided by a bushing formed of wear resistant material fixedly secured to said fixed nosepiece member.

9. A fastener driving device as defined in claim 8 wherein said nail feeding member includes a body portion extending in generally parallel relation with the direction of extent of said drive track, said fixed nosepiece member including a series of elongated fixed elements extending in the direction of extent of said feed track and spaced apart in the direction of extent of said drive track providing said first shanking controlling surface means, said body portion having recesses formed therein receiving said elongated elements, said teeth having integral with and extending laterally from said body portion between said elongated elements beyond the first shank controlling surface means thereof into a position adjacent said second shank controlling surface means.

10. A fastener driving device as defined in claim 3 wherein said abutment surface means comprises a laterally facing surface on said first tooth for engaging an area of said second shank controlling surface.

11. A fastener driving device as defined in claim 3 wherein said first head and shank controlling surface means are provided by a fixed nosepiece member and said second head and shank controlling surface means are provided by a door member pivotally mounted on said fixed nosepiece member for movement between a closed fixed operatively fixed position and an opened position providing access to said first head and shank controlling surfaces for fastener package exchanging purposes.

12. A fastener driving device as defined in claim 11 wherein said nail holding member is pivoted on said door member and said third spring means is mounted between said door member and said nail holding member.

13. A fastener driving device as defined in claim 11 wherein said first and second head controlling surfaces are planar surfaces extending at an included angle with the direction of extent of said drive track of approximately 75° and the tubular discharge end of said drive track is provided by a bushing formed of wear resistant material fixedly secured to said fixed nosepiece member.

14. A fastener driving device as defined in claim 11 wherein said nail feeding member includes a body portion extending in generally parallel relation with the direction of extent of said drive track, said fixed nosepiece member including a series of elongated fixed elements extending in the direction of extent of said feed track and spaced apart in the direction of extent of said drive track providing said first shank controlling surface means, said body portion having recesses formed therein receiving said elongated elements, said teeth having integral with and extending laterally from said body portion between said elongated elements beyond the first shank controlling surface means thereof into a position adjacent to said second shank controlling surface means.

15. A fastener driving device as defined in claim 3 wherein said first and second head controlling surfaces are planar surfaces extending at an included angle with the direction of extent of said drive track of approximately 75° and the tubular discharge end of said drive track is provided by a bushing formed of wear resistant material fixedly secured to said fixed nosepiece member.

* * * * *